US005205766A

United States Patent [19]

Arsenault

[11] Patent Number: 5,205,766

[45] Date of Patent: Apr. 27, 1993

[54] PROPELLER GUARD

[76] Inventor: Armand Arsenault, 11 Prospector Road, Whitehorse, YT Y1A 5G6, Canada

[21] Appl. No.: 894,376

[22] Filed: Jun. 4, 1992

[30] Foreign Application Priority Data

Jun. 11, 1991 [CA] Canada ..... 2.043.771

[51] Int. Cl.[5] ..... B63B 35/08

[52] U.S. Cl. ..... 440/72; 440/900

[58] Field of Search ..... 440/71, 72, 900; 416/247 A

[56] References Cited

U.S. PATENT DOCUMENTS

| | | | |
|---|---|---|---|
| 2,244,217 | 6/1941 | Pries | 440/72 |
| 2,597,551 | 5/1952 | Van Nort | 115/42 |
| 3,025,825 | 5/1960 | Martinson | 115/42 |
| 3,035,538 | 4/1961 | Willard | 115/42 |
| 3,889,624 | 6/1975 | Balius | 115/42 |
| 4,078,516 | 3/1978 | Balius | 115/42 |
| 4,565,533 | 1/1986 | Springer | 440/71 |
| 4,680,017 | 7/1987 | Eller | 440/66 |
| 4,957,459 | 9/1990 | Synder | 440/72 |

FOREIGN PATENT DOCUMENTS

| | | | |
|---|---|---|---|
| 1197736 | 12/1985 | Canada | 115/30 |
| 1267572 | 4/1990 | Canada | 115/30 |
| 1110925 | 10/1991 | Canada | 115/30 |

*Primary Examiner*—Edwin L. Swinehart
*Attorney, Agent, or Firm*—Browdy and Neimark

[57] ABSTRACT

A propeller guard for an outboard or stern drive motor having increased rigidity and stiffness is disclosed. The guard comprises an arcuate main spine, a plurality of side ribs and an upright brace. The spine comprises a channel adapted to engage the leg of the motor and clamping strap means for attachment of the guard to the motor.

6 Claims, 2 Drawing Sheets

PROPELLER GUARD

FIELD OF THE INVENTION

The invention relates to a propeller guard and more particularly to a propeller guard for a motor boat.

BACKGROUND OF THE INVENTION

Propeller guards have been known for some time.

U.S. Pat. No. 4,957,459 discloses a propeller guard comprising a welded wire cage having a number of spokes. A small gap between two of the spokes have adapted to receive the skeg. The propeller guard of this invention is attached to the motor by means of a retainer which is bolted through the anti-ventilation plate of the motor.

U.S. Pat. No. 4,565,533 discloses a propeller guard comprising a main rib from which extends a number of side ribs. A lower sleeve is welded to the main rib and is adapted to receive the fin of the outboard motor. The propeller guard is secured to the engine by means of a bracket and spring biased clamps.

It is an the object of the invention to provide a propeller guard having increased stiffness and rigidity.

SUMMARY OF THE INVENTION

According to a broad aspect, the invention relates to a propeller guard adapted for use with an outboard or stern drive marine motor. The propeller guard comprises a generally rigid and arcuate main spine, including a normally forward and upper generally upright portion and a normally rear and lower generally horizontal portion. The spine has and upper end and a rear end. A plurality of side ribs, each include a normally forward portion and a normally rear portion. The normally forward portions are connected to the generally upright portion of the main spine. The side ribs extend normally rearwardly from and generally transversely to the generally upright portion of the main spine. An arcuate, normally generally upright brace is fixedly secured to the rear portion of the side ribs and to the main spine at the rearmost end of the spine. The brace includes brace locking means adapted, when activated, to releasably connect end portions of the arcuate brace to each other to thus change the form of the brace from an arc to an enclosed, generally circular or oval reinforcing structure. The spine includes an inwardly open channel means adapted for engagement with a normally lower portion of the leg of a respective motor. The guard further comprises clamping strap means for attachment of the propeller guard to a respective motor. The clamping strap means are adapted to clamp against opposite sides of the leg of a respective motor. The clamping strap means include a normally foremost portion and a normally rearmost portion. The foremost portion is fixedly secured to the main spine at the upper end thereof. The rearmost portion of the clamping strap means is adapted for engagement with the brace locking means such that the brace locking means, when activated, also causes the clamping strap means to tightly engage the leg of a respective motor.

BRIEF DESCRIPTION OF THE DRAWINGS

The present invention will now be described in more detail with reference to the accompanying drawings which illustrate, by way of example, the preferred embodiment of the invention and in which.

DETAILED DESCRIPTION OF THE INVENTION

Figure 1:
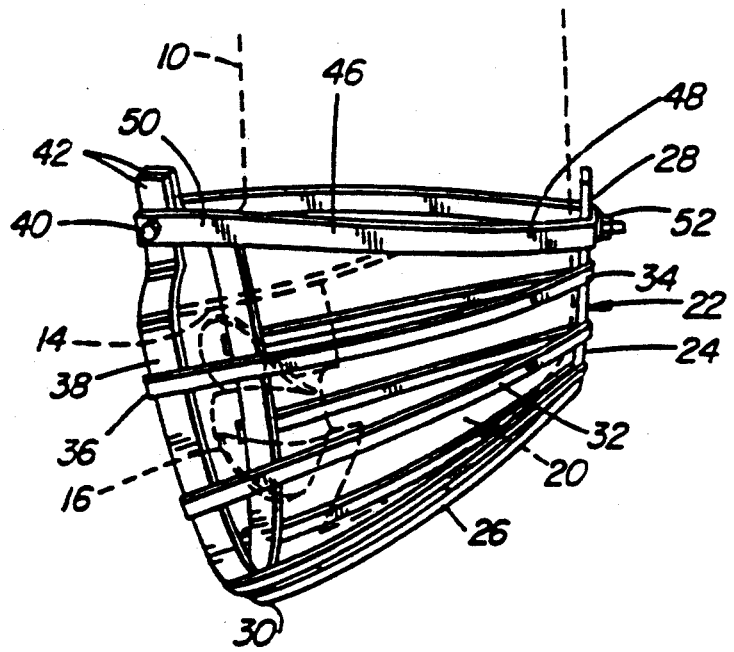
FIG. 1 is a perspective view of one embodiment of the guard attached to an outboard motor.

Referring to FIG. 1, the outboard motor shown in broken lines includes a drive shaft housing 10, a cavitation plate 14, a propeller 16 and a leg 20.

Figure 2:
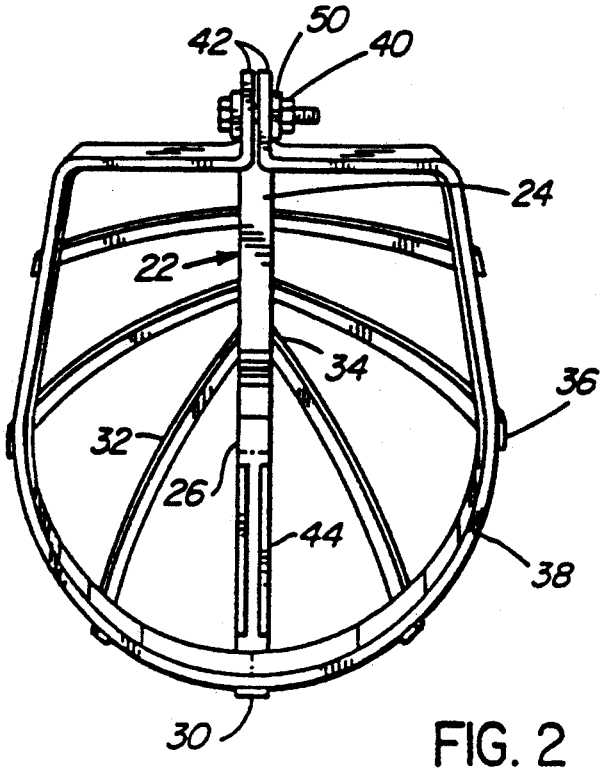
FIG. 2 is a perspective rear view of the embodiment of the guard shown in FIG. 1.
Figure 3:
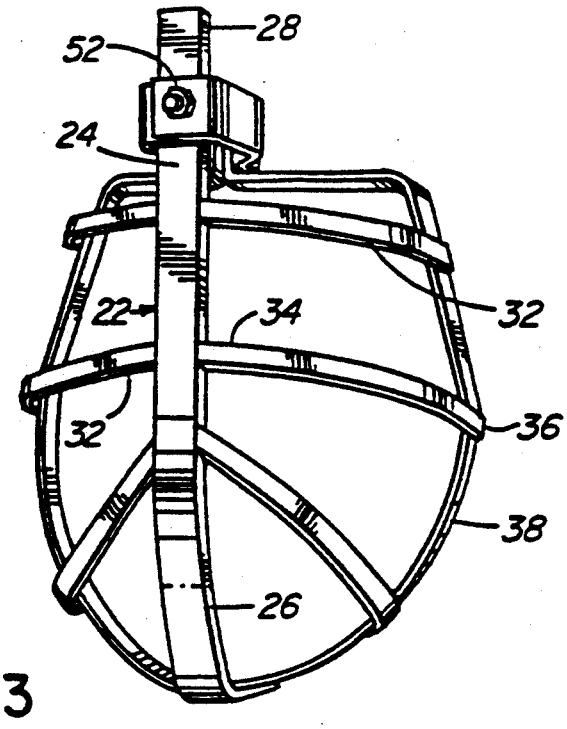
FIG. 3 is perspective front view of the embodiment of the guard shown in FIG. 1.

With reference to FIGS. 1 to 3, the guard according to the invention comprises a main spine 22 which, in use, extends from above the cavitation plate 14 to below the leg 20. The main spine is rigid and arcuate and includes a normally forward and upper generally upright portion 24 and a normally rear and lower generally horizontal portion 26. The main spine 22 has an upper end 28 and a rear end 30. To the main spine 22 there are welded four pairs of side ribs 32. Each side rib includes a normally forward portion 34 and a normally rear portion 36. The normally forward portion 34 of the side rib 32 is welded to the generally upright portion 24 of the main spine 22. The side ribs 32 extend normally rearwardly from and generally transversely to the generally upright portion 24 of the main spine 22.

An arcuate, normally generally upright brace 38 is welded to the rear portions 36 of the side ribs 32 and to the rear end 30 of the main spine 22. The brace 38 includes a nut and bolt assembly 40 adapted, when tightened, to releasably connect end portions 42 of the arcuate brace 38 to each other to thus change the form of the brace 38 from an arc to an enclosed, generally circular or oval reinforcing structure of the type illustrated in FIG. 1.

The main spine 22 includes an inwardly open channel 44 adapted for engagement with the lower portion of the leg 20 of the motor as illustrated in FIG. 1.

The propeller guard of the present invention further comprises a clamping strap 46 for attachment of the propeller guard to the motor boat or the like. The clamping strap 46 is adapted to clamp against opposite sides of the leg 20 of the motor. The clamping strap 46 includes a normally foremost portion 48 and a normally rearmost portion 50 as seen in FIG. 1. The foremost portion 48 of the clamping strap 46 is secured to the main spine 22 by means of a nut and bolt assembly 52 at the upper end 28 thereof. The rearmost portion 50 of the clamping strap 46 is secured to the brace 38 by the same nut and bolt assembly 40 which connects the end portions 42 of the brace 38 to each other such that when the end portions 42 of the brace 38 are connected to each other by the nut and bolt assembly 40, this also causes the clamping strap 46 to tightly engage the leg 20 of the motor.

To mount the guard on the motor, the nut and bolt assembly 40 is released and the guard is slid over the motor so that the channel 44 engaging the leg 20 of the motor. The guard is positioned so that the clamping strap 46 is placed on either side of the motor shaft 10 above the cavitation plate 14. The nut and bolt assembly 40 is then tightened. Attachment and detachment of the guard from the motor can generally be effected rapidly and without the need for specialized tools.

Figure 4:
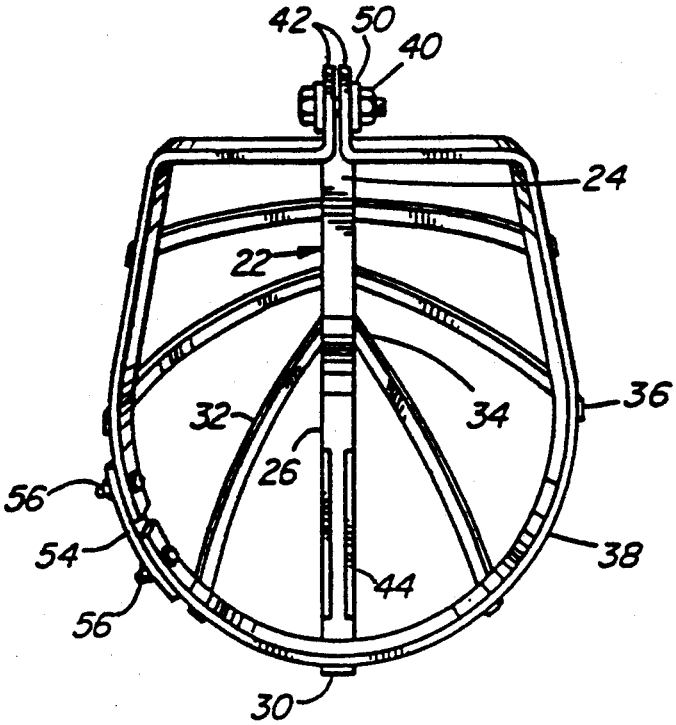
FIG. 4 is a perspective rear view of another embodiment of the guard of the present invention.

In another embodiment as illustrated in FIG. 4, the brace 38 comprises an expansion member 54 attached thereto by means of two nut and bolt assemblies 56. By loosening or tightening the nut and bolt assemblies 56, installation and removal of the guard from the motor is facilitated.

The guard can be made of steel. The construction of the present propeller guard provides it with stiffness and rigidity which along with the mode of attachment of the guard to the motor permits the propeller and the boat to move in unison when a submerged object is struck.

While the present invention has been described in connection with a specific embodiment thereof and in a specific use, various modifications will occur to those skilled in the art without departing from the spirit and scope of the invention as set forth in the appended claims. I therefor wish to embody within the scope of the patent which may be granted hereon all such embodiments as reasonable and properly come within the scope of my contribution to the art.

The embodiments of the invention in which an exclusive property or privilege is claimed are defined as follows:

1. A propeller guard adapted for use with an outboard or stern drive marine motor comprising:

(a) a generally rigid and arcuate main spine, including a normally forward and upper generally upright portion and a normally rear and lower generally horizontal portion, whereby the spine has an upper end and a rear end;

(b) a plurality of side ribs, each including a normally forward portion and a normally rear portion, each said normally forward portion being connected to said generally upright portion of the said main spine, said side ribs extending normally rearwardly from and generally transversely to the generally upright portion of the main spine; portion of the main spine;

(c) an arcuate, normally generally upright brace fixedly secured to the rear portions of said side ribs and to the main spine at the rearmost end of the spine; said brace including brace locking means for releasably connecting, when activated, end portions of the arcuate brace to each other to thus change the form of said brace from an arc to an enclosed, generally oval reinforcing structure;

(d) said spine including an inwardly open channel means for engagement with a normally lower portion of the leg of a motor;

(e) clamping strap means for attachment of the propeller guard to the motor, said clamping strap means being adapted to clamp against opposite sides of the leg of a motor, the clamping strap means including a normally foremost portion and a normally rearmost portion, the foremost portion being fixedly secured to the main spine at the upper end thereof; the rearmost portion of the clamping strap means being adapted for engagement with the brace locking means such that the brace locking means, when activated, also causes the clamping strap means to tightly engage the leg of the motor.

2. The guard as claimed in claim 1, wherein the brace, when locked, defines a contour which is larger than the contour circumscribed by outermost points of a propeller of a motor.

3. The guard as claimed in claim 1 further comprising expansion means for said brace.

4. The guard of claim 3 wherein said expansion means comprises an expansion member attached to separate parts of said brace by nut and bolt assemblies.

5. The guard of claim 3 wherein said brace is formed of steel.

6. The guard of claim 2 further comprising expansion means for said brace for expanding the size of said brace for installation and removal of said guard from a motor, said guard being formed of metal.

* * * * *